US005940990A

United States Patent [19]

Barret

[11] Patent Number: 5,940,990

[45] Date of Patent: Aug. 24, 1999

[54] SHOE WITH AN AT LEAST PARTIALLY ELASTIC LINING AND VOLUME ADJUSTING SYSTEM

[75] Inventor: Thierry Barret, Choisy, France

[73] Assignee: Salomon S.A., Metz-Tessy, France

[21] Appl. No.: 08/665,892

[22] Filed: Jun. 19, 1996

[30] Foreign Application Priority Data

Jun. 30, 1995 [FR] France ..... 95.08084

[51] Int. Cl.[6] ..... A43B 23/07; A43C 11/00

[52] U.S. Cl. ..... 36/55; 36/50.1

[58] Field of Search ..... 36/50.1, 50.5, 36/55, 117.2

[56] References Cited

U.S. PATENT DOCUMENTS

| | | | |
|---|---|---|---|
| 2,147,197 | 2/1939 | Glidden | 36/9 R |
| 4,736,531 | 4/1988 | Richard | 36/114 |
| 5,345,697 | 9/1994 | Quellais | 36/50.1 |
| 5,392,535 | 2/1995 | Van Noy et al. | 36/50.1 X |
| 5,416,987 | 5/1995 | Bemis et al. | 36/50.1 |
| 5,471,769 | 12/1995 | Sink | 36/50.1 |
| 5,533,279 | 7/1996 | Mitsui et al. | 36/55 X |
| 5,537,763 | 7/1996 | Donnadieu et al. | 36/50.5 X |
| 5,566,474 | 10/1996 | Leick et al. | 36/50.5 X |
| 5,566,475 | 10/1996 | Donnadieu | 36/55 |
| 5,647,104 | 7/1997 | James | 36/50.1 X |

FOREIGN PATENT DOCUMENTS

| | | | |
|---|---|---|---|
| 0109384 | 5/1984 | European Pat. Off. | A43B 5/04 |
| 0287358 | 10/1988 | European Pat. Off. | A43B 5/00 |
| 0521287 | 1/1993 | European Pat. Off. | A43B 5/00 |
| 0651953 | 5/1995 | European Pat. Off. | A43B 5/04 |
| 2711896 | 5/1995 | France . | |

*Primary Examiner*—B. Dayoan
*Attorney, Agent, or Firm*—Greenblum & Bernstein P.L.C.

[57] ABSTRACT

A shoe of the type constituted of an upper, an external sole, and a lining at least partially elastic arranged within the shoe. The elastic lining defines, at rest, a volume at least equal to that of the largest volume of the foot adapted to be received in the shoe, and includes an arrangement for adjusting its volume in view of an adaptation thereof to the real volume of the foot placed inside the shoe. Advantageously, the volume adjustment arrangement is constituted by a double row of guides facing one another in a limited area of the elastic lining and spaced apart by a value corresponding substantially to the maximum difference in the volume of the foot, and by a loop through lace passing through the guides and associated with a traction and blocking device for the lace.

17 Claims, 4 Drawing Sheets

6
7
19
2
12
10
16
5
11
8
1

SHOE WITH AN AT LEAST PARTIALLY ELASTIC LINING AND VOLUME ADJUSTING SYSTEM

BACKGROUND OF THE INVENTION

1. Field of the Invention

The present invention relates to a shoe adapted more particularly for sport practice, of the type constituted of an upper and an external sole, as well as of a lining at least partially elastic arranged within the upper.

2. Background and Material Information

The use of such elastic linings, especially in sport shoes, is increasingly favored for the proprioceptive qualities which they provide.

For example, the U.S. Pat. No. 2,147,197, filed in 1936, shows a sport shoe constituted of a jersey sock anchored through its end on the sole, and of an external upper partially surrounding the sock and fixed on the sole in manner that is totally independent of the sock, the knitted structure of the sock providing the latter with a certain elasticity.

The U.S. Pat. No. 4,736,531, filed more recently in 1987, shows a sport shoe, adapted more particularly to aerobics, which includes a kind of internal half-sock completely surrounding the fore-foot, and whose end is anchored on the external sole, the sock being free to "grip" the foot independently of the external upper.

In this case, the sock is made out of an extensible material such as that known by the commercial name spandex, which, unlike the U.S. Pat. No. 2,147,197, actually enables the sock to tightly envelop the foot and to follow the movements thereof.

Different constructions of sport shoes have likewise been proposed by the Applicant in the French document No. FR 2 711 896, such shoes being more particularly adapted for cross country skiing, and incorporating a lining made of an elastic material arranged within an upper, in order to increase the sensations of the foot and of the ankle, and to locate, in an accurate manner, the respective space positions of such sensations that are indispensable to obtain a good precision of the movement.

In fact, the type of shoe known from these two patents uses the proprioceptive qualities of certain parts of the foot and of the ankle.

To obtain an optimum response, it is necessary that the elastic lining tightly envelop the foot and the ankle by constituting a kind of a second skin, regardless of the foot inserted inside the shoe.

Such an elastic lining must therefore be configured so as to define, at rest, a volume slightly less than the volume of the foot which it is adapted to receive, so as to exert a slight regular pressure thereon, without any excessive tightening.

In practice, these elastic linings are therefore designed with a volume slightly less than the volume of the narrowest foot that can be placed inside the shoe.

As a result, difficulties arise when putting on the shoe, especially for larger feet, these difficulties being more substantial as the elastic lining "rises" higher on the ankle as in the case of the sport shoes featured in the French document No. 2 711 896.

It has been provided in the above-identified French document No. 2 711 896 to provide the elastic lining with a slit allowing for the positioning of the foot and being capable of being closed by self-gripping means.

However, such a construction does not allow for an accurate adjustment and adaptation of the volume of the sock or elastic lining to the volume of the foot.

Moreover, this construction with an opening slit is not compatible with the use of a high, closed upper which only provides a very limited access to the inside of the shoe, such access being insufficient to easily open and close the slit of the lining.

One can also provide that the volume of the elastic lining correspond to that of an average foot to be placed inside of the shoe. In this case, the problem of inserting large feet in the shoe remains, whereas a narrow foot does no longer benefits from the tight enveloping of the elastic lining.

Finally, it is also advisable to be able to maintain a completely closed elastic lining structure, especially for reasons related to imperviousness.

SUMMARY OF THE INVENTION

Therefore, the object of this invention is to overcome these disadvantages, and to provide a construction for a shoe with an improved elastic lining that reconciles the opposing problems related to an easy insertion of the foot, accurate adaptation to the volume thereof, and imperviousness.

The object of the present invention is also to improve the comfort aspects and proprioceptive sensations of such a shoe.

This object is achieved in the shoe according to the invention that is of the type constituted of an upper, an external sole, and a lining at least partially elastic arranged inside of the shoe, by the fact that the elastic lining defines, at rest, a volume that corresponds at least to that of the largest foot adapted to be received in the shoe, and that it includes means for adjusting its volume in view of an adaptation thereof to the real volume of the foot placed inside the shoe.

Such a construction makes it possible to maintain a completely closed elastic lining, while allowing for an easy positioning of the foot due to the larger volume of this lining, and offering a possibility of accurate adaptation to each foot and, therefore, greater proprioceptive qualities.

According to an advantageous embodiment, the volume adjustment means are constituted by a double row of guides facing one another in a limited area of the elastic lining and spaced apart by a value corresponding substantially to the maximum difference in the volume of the foot, and by a loop through lace passing through the guides and associated with a traction and blocking means of this lace.

Thus, it suffices to exert a traction on the loop of the lace to bring the two rows of guides close together and to block this loop in the desired position in order to reduce the volume of the elastic lining to the desired value.

According to another aspect of the invention, the shoe is provided with a tongue that is elastically biased by the elastic lining against the user's foot.

With such a construction, the tongue is pressed on the entire top portion of the foot, instep of the user, which makes it possible, on the one hand, to increase the area of the foot that is biased by the elastic lining and, therefore, to increase the proprioceptive sensations and information received by the foot and, on the other hand, to distribute, by means of the tongue serving as a pressure distribution plate, all of the elastic pressure exerted by the elastic lining over the entire portion of the foot being in contact with the tongue, i.e., both the top of the foot and the front tibial portion and, therefore, to obtain a more homogeneous and more comfortable distribution of pressure for the foot.

Such an embodiment is particularly interesting in the case of mountain or safety shoes provided with a relatively rigid external upper and equally relatively rigid tongue. Due to its relative rigidity, the tongue is entirely pressed on the corresponding portions of the foot and of the ankle.

BRIEF DESCRIPTION OF DRAWINGS

The invention will be better understood and other characteristics thereof will become apparent upon reading the description that follows, with reference to the annexed schematic drawings, illustrating a few preferred embodiments, and in which.

DETAILED DESCRIPTION OF THE PREFERRED EMBODIMENTS

Figure 1:
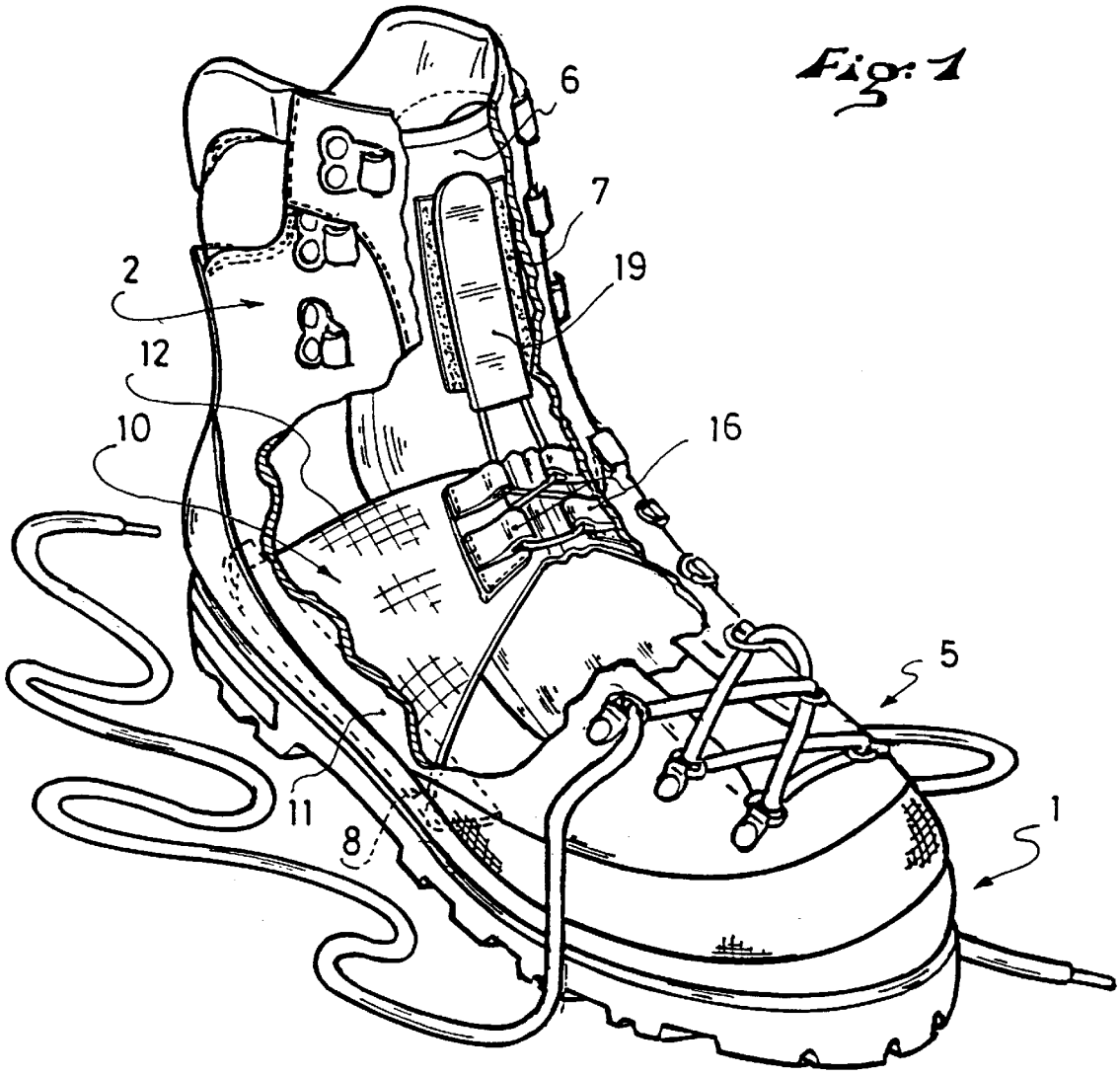
FIG. 1 is a three quarter perspective front view with partial cutaway of a shoe incorporating the invention.
Figure 2:
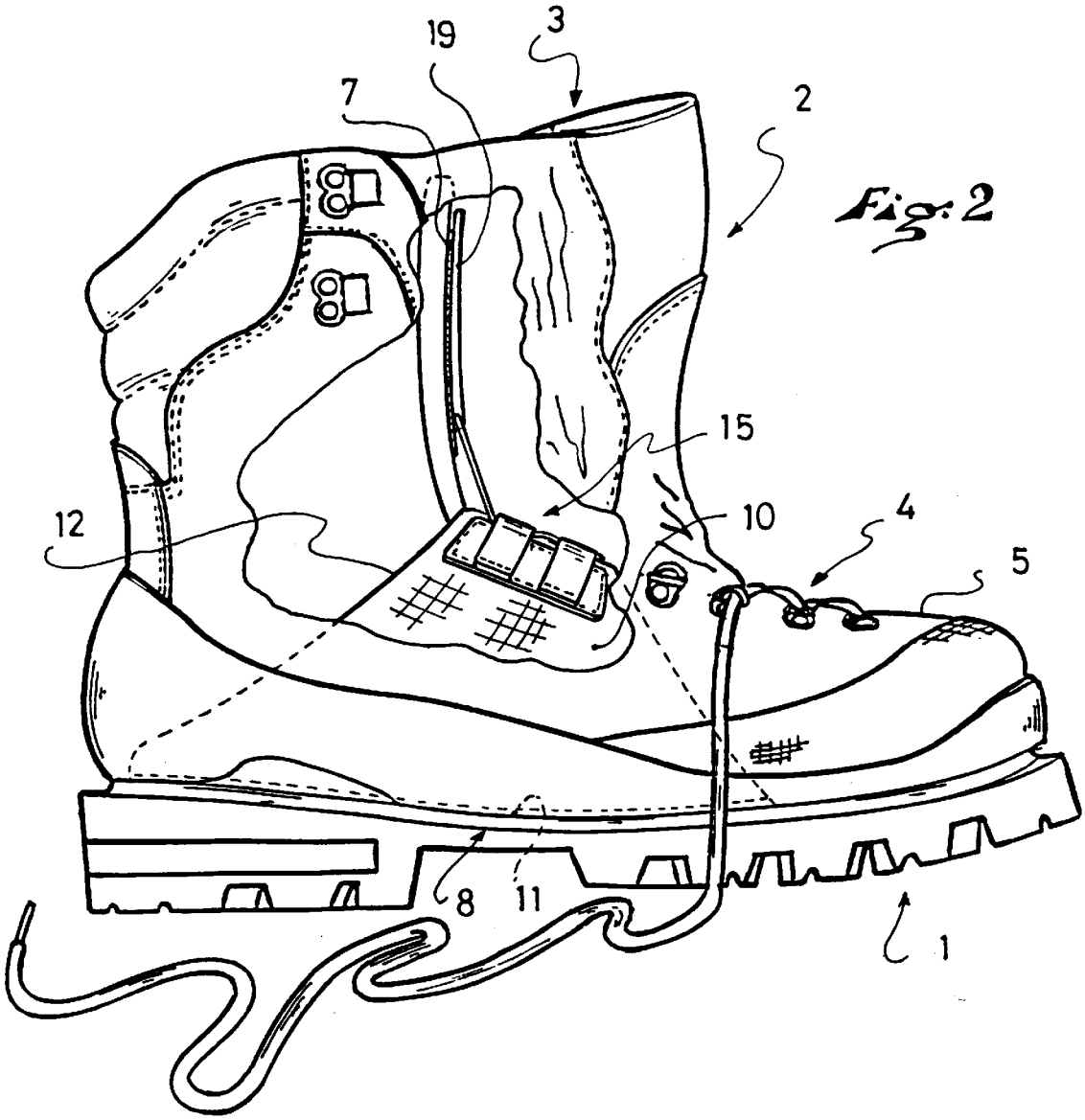
FIG. 2 is a side view of FIG. 1 with partial cutaway.

FIGS. 1 and 2 show the application of the invention to a sport shoe of the walking/mountain type.

Such a shoe is constituted, in a known manner, of a walking sole 1 topped by an external upper 2, so-called high upper because it rises beyond the ankle journal.

As shown more particularly in FIG. 2, the upper 2 has a single opening 3 arranged only at its upper end, and has the shape of a "wide" boot that can be tightened around the foot and leg by means of a lacing 4 extending on the top of the foot, from the tip 5 of the shoe up to the opening 3 of the upper 2, thereby constituting an example of an external tightening system.

The shoe further includes, within the upper 2, a tongue 6 of a known type provided, on its upper surface, with an attachment means, such as a self-gripping means 7 and whose role will be explained subsequently, and a lining 10 at least partially elastic.

In the example shown in FIGS. 1 and 2, the elastic lining 10 is constituted by a semi-circular hand made of an elastic material extending continuously over the instep portion of the shoe while passing above the tongue 6, and fixed in a known manner to the upper 2 and to the external sole 1 through each of its lower ends 11 in the zone 8 for assembling to upper and the sole, and commonly referred to as the "lasting allowance."

The elastic lining 10 could also be fixed through its lower ends 11 only to the upper 2, possible at different levels along the height of the upper in order to obtain differentiated tightening effects.

It is noted that the rear edge 12 of the elastic lining 10 extends up to the heel area of the shoe to obtain sensations that extend from the instep to the heel.

Figure 3:
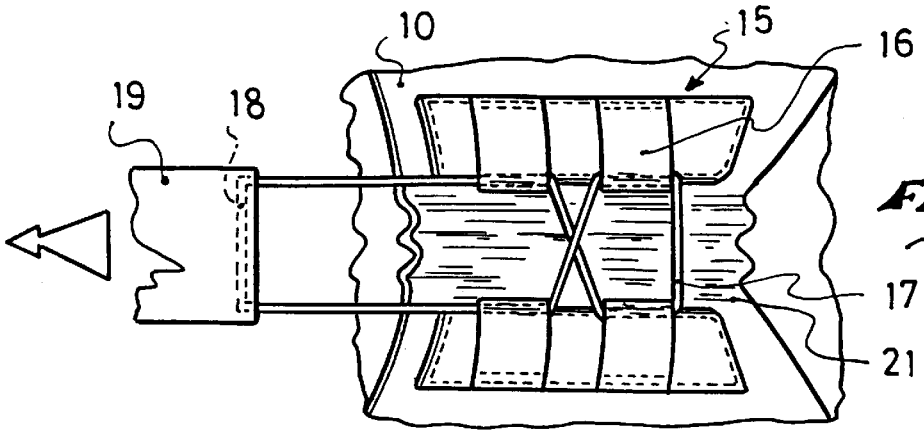
FIG. 3 shows, in a top view, a constructional detail of FIG. 2.

As shown more particularly in FIGS. 1 and 3, the elastic lining 10 defines, at rest, a volume at least equal to that of the largest volume of the foot to be received in the shoe, and includes, on its instep top portion, means 15 for adjusting its volume.

These adjustment means 15 are constituted by a double row of guides 16 and a lace 17 cooperating with the guides 16, the latter being arranged on the elastic lining 10 substantially along the longitudinal axis of the shoe and mutually spaced apart by a value corresponding substantially to the maximum difference between the volumes of the foot that can be received in the shoe.

In other words, the spacing of these two rows of guides 16 is such that the volume defined between the elastic lining and the bottom of the shoe at rest, i.e., without the guides coming close together, corresponds to the maximum volume of the foot that can be received, whereas the volume defined by this lining in the tightened state, i.e., when the guides 16 are brought close together to the maximum by the lace 17, corresponds to the minimum volume of the foot that can be received. As shown more particularly in FIG. 3, the lace 17 forms a closed loop whose free end 18 is provided with a lug or tab 19 provided on its lower surface with an attachment or self-gripping means, complementary of the self-gripping means 7 of the tongue 6, to allow for a hooking of the latter on the lug 19.

The functioning of the assembly is very simple. Initially, for the positioning of the foot inside the shoe, the lug 19 is manually detached from the tongue 6 and the guides 16 of the elastic lining 10 are spaced apart to the maximum so as to release a maximum volume for the elastic lining. Thus, the insertion of the foot inside the shoe can be done without any problem, even for a "large" foot, i.e., a foot having a large instep, the opening demarcated by the rear edge 12 of the elastic lining 10 being capable of being enlarged further, if necessary, by means of the tongue 6 arranged beneath the elastic lining 10 and then serving as a control member.

Once the foot is inside the shoe, it suffices to adjust the contour of the elastic lining 10 to that of the foot by bringing the guides 16 close together by means of a manually traction exerted on the lace 17 by means of the lug 19.

Once the desired adjustment is obtained for the elastic lining 10, it suffices to hook the lug 19 to the desired area on the tongue 6 to maintain the tension of the lace 17 and the volume of the elastic lining at the desired value. The lug 19 is thus designed as an element for applying a traction force to the lace 17 and for blocking the lace in place with respect to the guides 16, after the traction force is applied.

A perfect adaptation of the elastic lining to the contour of the foot actually forming a second skin is obtained in this way and very simply, while preserving the characteristics thereof outside of the adjustment zone constituted by the guides 16 and lace 17.

A better transmission and sensation of the information from the ground are therefore obtained, as well as a better sensation of the space position of the foot with respect to the ankle. The closure of the shoe is then completed by a tightening of the external upper around the foot, which is necessary for a good holding thereof.

It is noted that the adjustment of the volume of the lining 10 can be accompanied by the formation of slight folds 21 in the area of the adjustment zone i.e., in the area of the guide 16 and lace 17. But these folds are in fact not a hinderance:

due to the presence of the tongue 6 inserted between the foot and the lining, due to the low tension exerted by the elastic lining on the foot.

The tongue 6 has not been particularly described because it is known in itself. In fact, it is a comfort element that is padded and fixed to the upper either at the level of the front end of the lacing 4, or even at the tip of the shoe.

The embodiment of the adjustment system, in the form of flat guides cooperating with a lace, is interesting because it offers a particularly flat embodiment, necessary in order to avoid any overpressure or formation of a hard spot on the foot during the tightening of the external upper. Of course, other adjustment means could be envisioned insofar as they do not create any overpressure.

In the case where the external upper is a so-called low upper, i.e., that does not extend beyond the malleoli, the fixing of the hooking lug 19 of the adjustment means 15 could be done on the exterior of the external upper 2 instead of the tongue 6.

Furthermore, the invention is particularly interesting in an application in which a shoe has an upper in the form of a "boot" as shown in FIGS. 1 and 2, due to the reduced opening 3 provided by such a boot which only offers a reduced access to the interior and to the difficulty resulting therefrom for having an internal tightening itself.

The embodiment of FIG. 4 distinguishes over that of FIGS. 1 and 2 by a two-part elastic lining, i.e., that includes an instep portion 10' provided with adjustment means 15, similar to that described in connection with FIGS. 1 and 2, and an ankle portion 30 adapted to surround the user's ankle.

In this case, the ankle portion 30 is likewise designed so as to offer a volume that is at least equal to that of the largest volume of the foot (the term "foot" here encompassing both the foot itself and the ankle) adapted to be received in the shoe, and includes, on its portion, means for adjusting its volume, such means being constituted of a double row of guides 36 and of the lace 17.

In the case shown, the same lace 17 therefore cooperates with the guides 16, 36 for the adjustment of the volume of the two parts of the elastic lining, and becomes hooked to the tongue 6 through its lug 19.

It is also possible to provide two distinct laces with different hooking zones.

Figure 4:
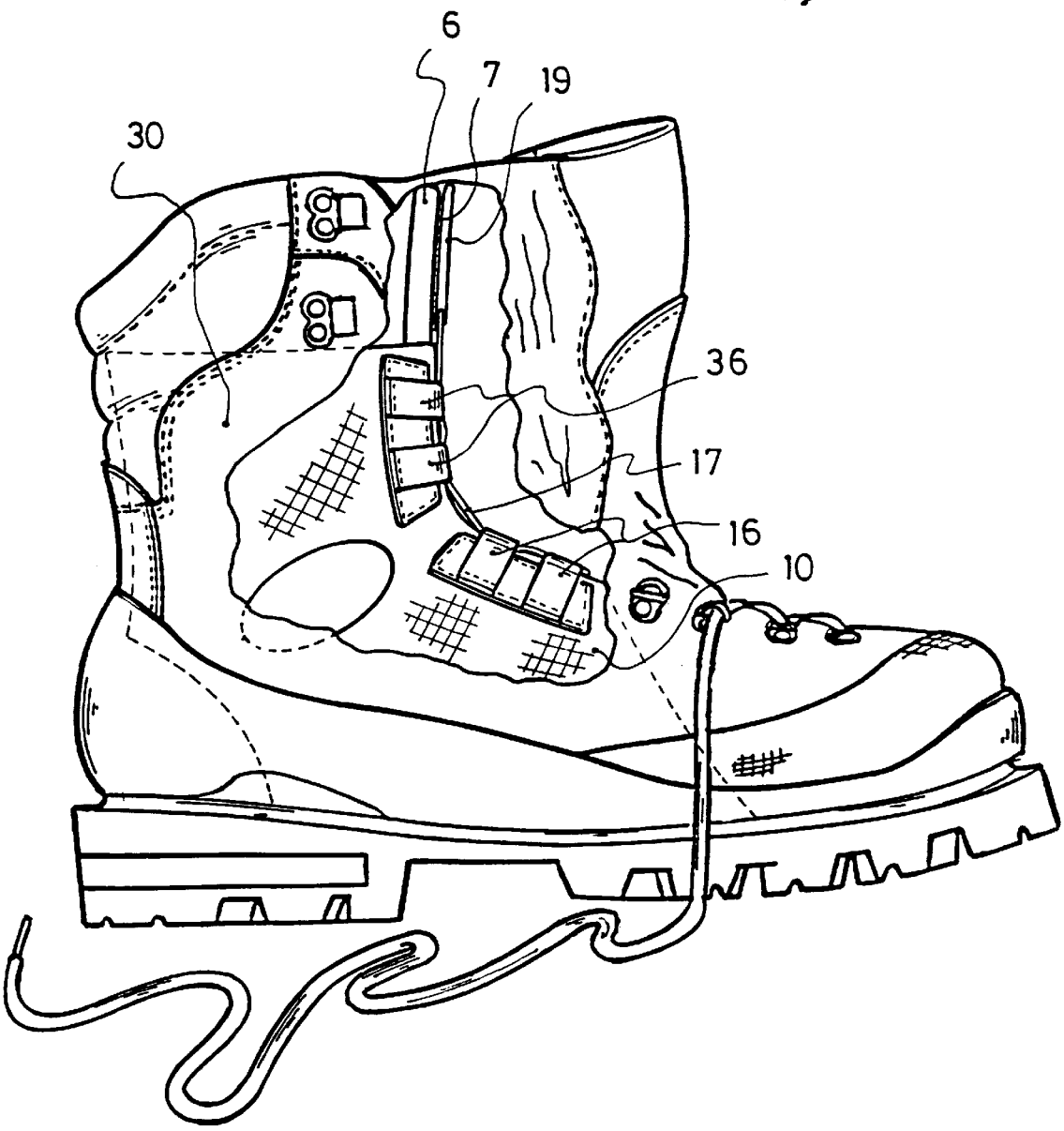
FIG. 4 is a view similar to that of FIG. 2 of a shoe according to a second embodiment.

Finally, the two parts of the lining 10, 30, can be affixed to one another and form a single piece as shown in FIG. 4, or they can rather be made in several portions with one or more adjusting laces.

Figure 5:
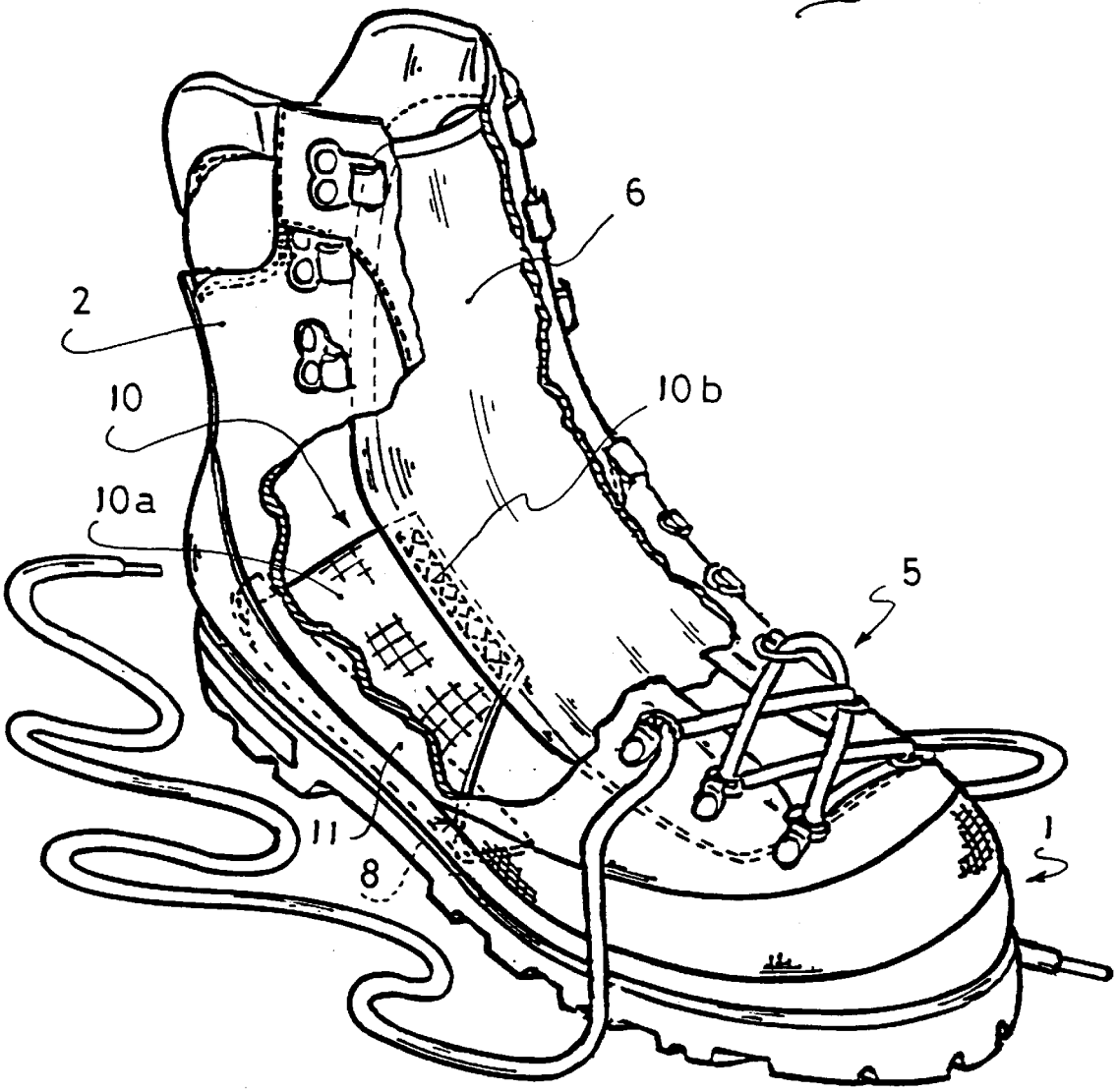
FIG. 5 is a view similar to that of FIG. 2 of a shoe according to a third embodiment.

The embodiment shown in FIG. 5 differs from the two previous embodiments due to the fact that the tongue 6 is assembled directly to the elastic lining portion 10, which is reduced in this case to two elastic bands 10*a* arranged on both sides of the tongue, and elastically connecting the latter to the sole. Each elastic band 10*a* is fixed to the tongue 6 through its upper end 10*b*, on the one hand, and through its lower end 11 in the zone 8 for assembling the upper 2 and the sole 2 or on the upper itself, on the other hand.

In this embodiment, the elastic lining portion 10 is not provided with means for adjusting its volume, and the volume defined by the tongue and the elastic lining portion is provided so as to adjust to the minimum volume of the foot adapted to be received inside the shoe.

In such an embodiment, the presence of the tongue 6 distributing the pressure makes it possible to avoid any risk of overpressure on the foot, even for a foot with a large volume.

Such a construction is particularly interesting and advantageous for the mountain or safety shoes, i.e., shoes that are provided with an external upper made of a thick and resistant material, and difficult to adapt in an accurate fashion to the volume of the foot, because it makes it possible to obtain an excellent envelopment of the foot and of the ankle at low cost, and therefore to increase the proprioceptive sensations and the transmission of information on the space positions thereof.

A relative rigidity of the tongue is likewise indispensable in such case to obtain a good distribution of pressure on the zone of the top of the foot, including the ankle, and to avoid the formation of a localized and hindering pressure in the location of the elastic bands 10*a*. Moreover, such a relative rigidity of the tongue 6 facilitates the handling of the latter and its opening, as well as that of the elastic lining 10 in view of the positioning of the foot. Of course, this relative rigidity will be determined so as not to hinder the use of the shoe and, especially walking.

Of course, the present invention is not limited to the embodiments described hereinabove by way of non-limiting examples. Thus, the means for hooking the lace could, for example, be constituted by a succession of hooks in which the upper loop of the lace could be engaged.

Likewise, the means for adjusting the volume, and especially the traction and blocking means of the lace, could be obtained in a different manner without leaving the scope of the present invention.

The instant application is based upon French Patent Application No. 95.08084, filed on Jun. 30, 1995, the disclosure of which is hereby expressly incorporated by reference thereto in its entirety and the priority of which is claimed under 35 USC 119.

What is claimed:

1. A shoe comprising:

an external sole;

an external high upper affixed to said external sole;

an external tightening system arranged on said upper above the foot;

an internal lining positioned within said external upper and extending over an instep portion of the foot, said lining being at least partially elastic and applying an elastic force to the instep portion of the foot, said at least partially elastic lining defines, at rest, a volume at least equal to a volume of the largest foot adapted to be received within the shoe; and means, independent of said external tightening system, for adjusting said volume defined by said lining, at rest, to a magnitude corresponding to a foot received within said lining, while maintaining an elastic force to the instep portion of the foot.

2. A shoe according to claim 1, wherein:

said volume adjusting means comprises:

a double row of guides facing one another in a limited area of said lining and spaced apart by a value substantially corresponding to a maximum difference in a largest and smallest foot adapted to be received within said lining;

a lace passing through said guides; and a means for applying traction and blocking said lace in a predetermined position with respect to said guides after said traction is applied.

3. A shoe according to claim 2, wherein:

said lace comprises an upper loop located upwardly from said guides;

said traction and blocking means comprises a lug fixed to said upper lop of said lace, said lug further comprising a attachment means; and the shoe further comprising another attachment means complementary to said attachment means of said lug, whereby engagement of said attachment means with said complementary attachment means blocks said lug in place.

4. A shoe according to claim 3, wherein:

both said attachment means and said complementary attachment means are self-gripping attachment means.

5. A shoe according to claim 3, further comprising:

a tongue extending beneath said lining over the instep portion of the foot; and wherein said complementary attachment means are fixed on said tongue.

6. A shoe according to claim 4, further comprising:

a tongue extending beneath said lining over the instep portion of the foot; and wherein said complementary attachment means are fixed on said tongue.

7. A shoe according to claim 1, wherein:

said volume adjusting means is located above said instep portion.

8. A shoe according to claim 2, wherein:

said volume adjusting means is located above said instep portion.

9. A shoe according to claim 1, further comprising:

a tongue positioned within said external upper and within said lining; and said volume adjusting means is positioned on said lining and over said tongue.

10. A shoe according to claim 1, wherein:

said lining has a rear edge extending rearwardly from an instep area to an area corresponding to a rear portion of a heel of a foot.

11. A shoe according to claim 1, wherein:

said external high upper comprises an upper end, said external high upper having a single opening for receiving a foot only at said upper end.

12. A shoe according to claim 9, wherein:

said external high upper comprises an upper end, said external high upper having a single opening for receiving a foot only at said upper end.

13. A shoe according to claim 10, wherein:

said external high upper comprises an upper end, said external high upper having a single opening for receiving a foot only at said upper end.

14. A shoe according to claim 1, wherein:

said external high upper is relatively rigid.

15. A shoe according to claim 1, wherein:

said lining has a shape to enable said lining to extend over an ankle of the foot.

16. A shoe according to claim 1, wherein:

said external high upper has a height adapted to extend above an ankle of the foot.

17. A shoe comprising:

an external sole;

an external high upper affixed to said external sole;

an external tightening system arranged on said upper above the foot;

an internal lining positioned within said external upper and extending over an instep portion of the foot, said lining being at least partially elastic and applying an elastic force to the instep portion of the foot, said at least partially elastic lining defines, at rest, a volume at least equal to a volume of the largest foot adapted to be received within the shoe; and a volume adjusting system, independent of said external tightening system, for adjusting said volume defined by said lining, at rest, to a magnitude corresponding to a foot received within said lining, while maintaining an elastic force to the instep portion of the foot.

* * * * *